US007395765B1

(12) United States Patent
Dorfman

(10) Patent No.: US 7,395,765 B1
(45) Date of Patent: Jul. 8, 2008

(54) ROTATABLE TABLE AND METHOD OF USE

(76) Inventor: Mitchell K. Dorfman, 26526 Bighorn Way, Valencia, CA (US) 91354

( * ) Notice: Subject to any disclaimer, the term of this patent is extended or adjusted under 35 U.S.C. 154(b) by 444 days.

(21) Appl. No.: 11/078,759

(22) Filed: Mar. 11, 2005

Related U.S. Application Data

(63) Continuation-in-part of application No. 10/303,370, filed on Nov. 25, 2002, now abandoned.

(51) Int. Cl.

| | |
|---|---|
| ***A47B 5/00*** | (2006.01) |
| ***A47B 67/02*** | (2006.01) |
| ***A47B 88/00*** | (2006.01) |
| ***A47F 5/12*** | (2006.01) |
| ***A47G 29/02*** | (2006.01) |

(52) U.S. Cl. ..... 108/48; 108/42; 108/9; 312/248; 312/325; 248/235; 248/242

(58) Field of Classification Search ..... 108/48, 108/9, 6, 42; 312/246, 248, 325; 248/235, 248/241

See application file for complete search history.

(56) References Cited

U.S. PATENT DOCUMENTS 5,381,738 A * 1/1995 Meyer ..... 108/42
5,669,314 A * 9/1997 Grant ..... 108/48

* cited by examiner

*Primary Examiner*—Milton Nelson, Jr.
(74) *Attorney, Agent, or Firm*—Ted Masters

(57) ABSTRACT

A rotatable table includes a shelf unit which is mounted on a support structure and a rotatable unit having a work surface which may be rotated from a horizontal position to a vertical position. The rotatable unit may be placed in (1) a horizontal position, (2) specific detent angular positions, (3) other angular positions selected by the user, and (4) a storage position wherein the work surface is vertical. A truss assembly guide which slidably receives a truss assembly makes the various angular positions possible. In an embodiment of the invention, the entire rotatable table is vertically positionable on the support structure.

9 Claims, 14 Drawing Sheets

Fig. 10
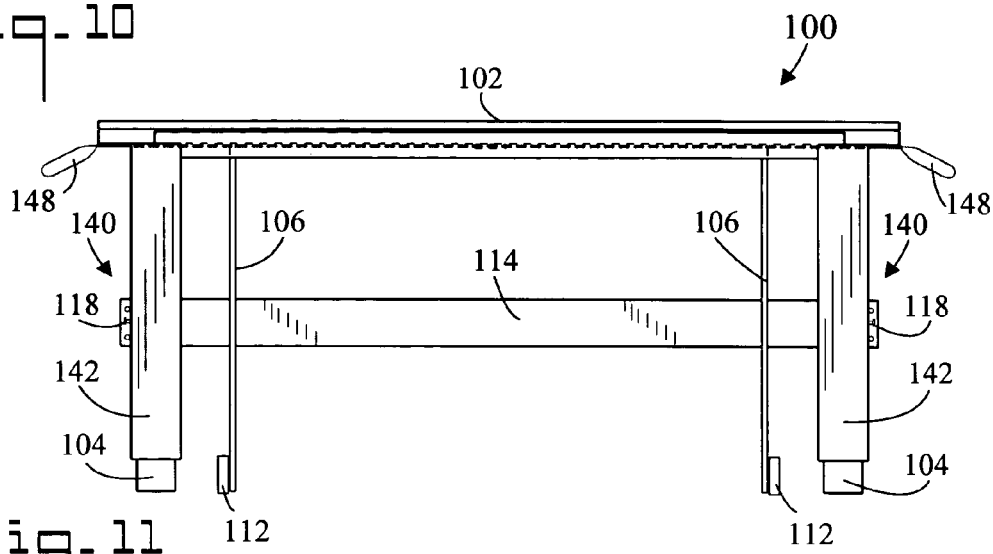
Fig. 11
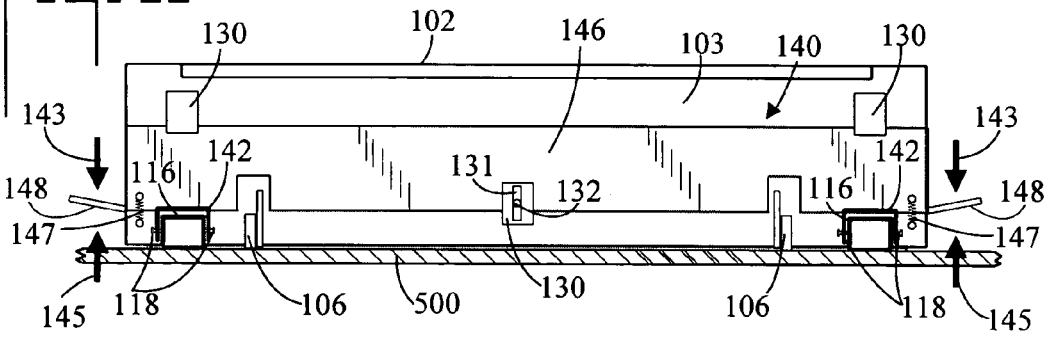
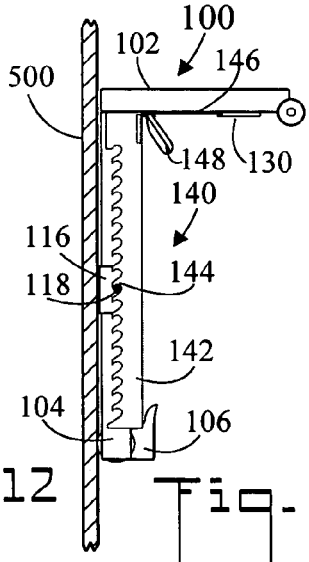
Fig. 12
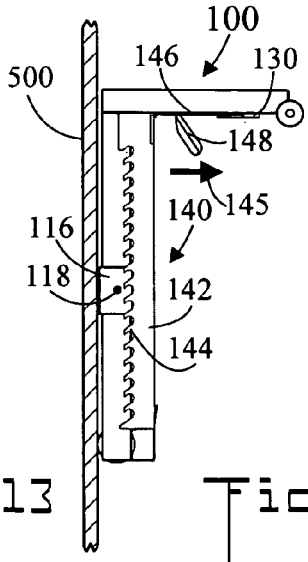
Fig. 13
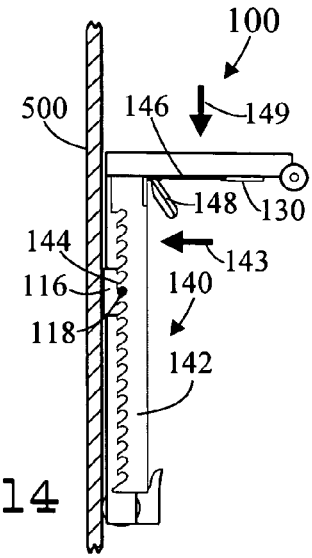
Fig. 14

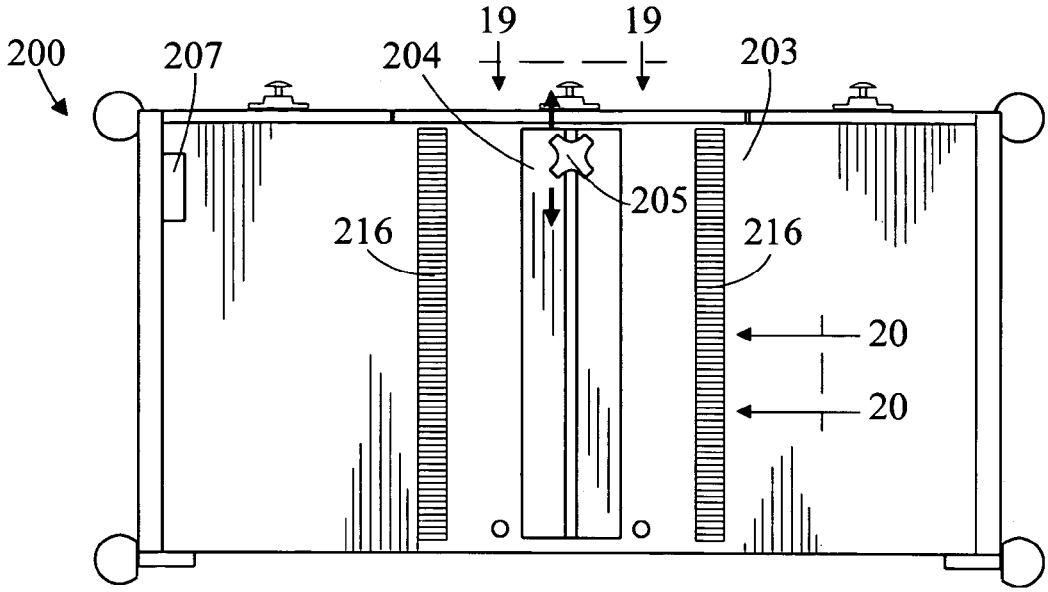
Fig. 18
Fig. 19
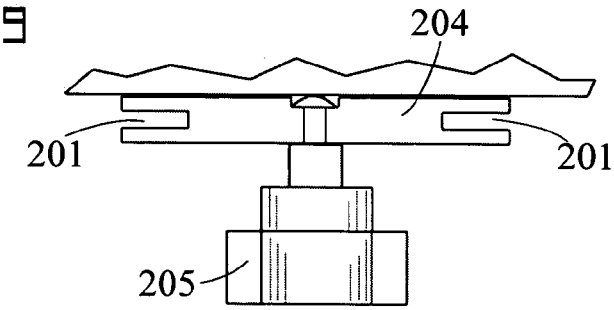
Fig. 20
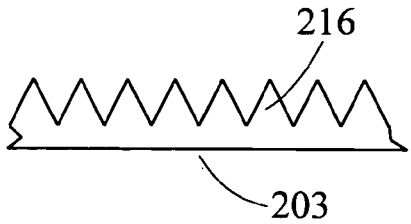

Fig. 22
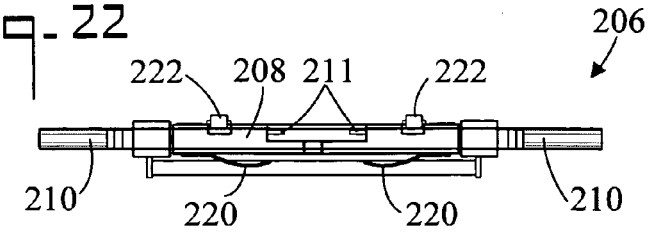
Fig. 21
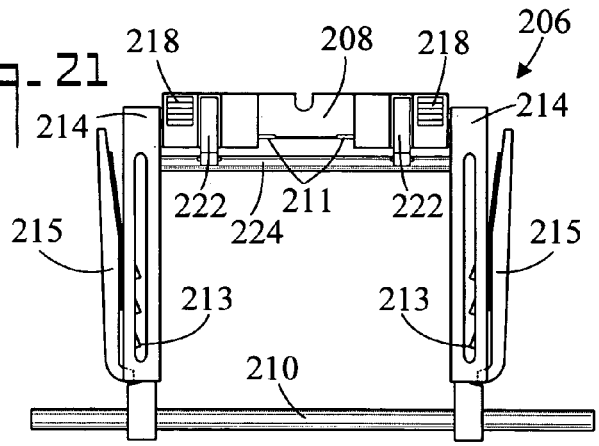
Fig. 23
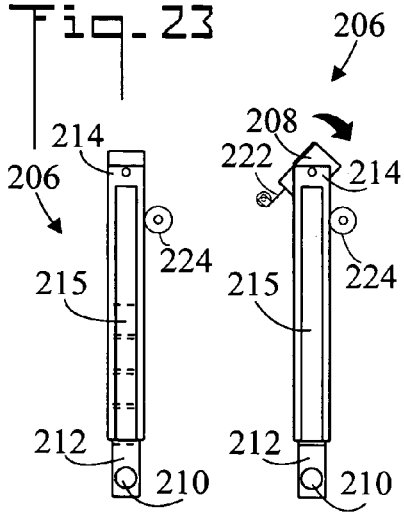
Fig. 24
Fig. 25
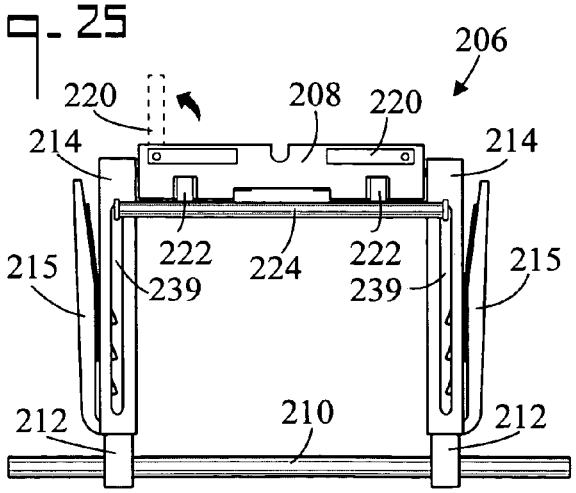

ROTATABLE TABLE AND METHOD OF USE

CROSS REFERENCE TO RELATED APPLICATION

This application is a Continuation-In-Part of application Ser. No. 10/303,370, filed Nov. 25, 2002, now abandoned which is included herein by reference.

TECHNICAL FIELD

The present invention pertains generally to furniture of the desk variety, and more particularly to a wall mounted table having a work surface which may be placed and locked at positions between horizontal and vertical.

BACKGROUND OF THE INVENTION

Folding furniture is well known in the art. For example, U.S. Pat. No. 2,650,145 shows a collapsible wall table. In one position the device forms a table, and in another position comprises a wall ornament.

U.S. Pat. No. 4,313,385 illustrates a folding table (10) which is pivotally mounted to a vertical support (12) by a pair of longer arms (16) and two pairs of shorter arms (18), so that it can swing from a horizontal position to a vertical position against the support. A ground engaging leg (30) of adjustable length is hinged at (32) to the outer end of the table and can be swung up under the table when the table is to be folded away. The shorter arms (18) lie lengthwise in channel brackets (24) when the table is extended, thereby giving the table better lateral support. Adjustable stops (28) engage the underside of the table when extended.

U.S. Pat. No. 4,501,457 discloses a kitchen table for use with a motor vehicle camper, which is collapsible as a storage unit to carry cooking utensils. The table comprises a pair of panels which face each other to form a closed unit. The panels are hinged to open outwardly with one edge of the unit engagable with a wall hanger and an extensible leg to support the unit in a horizontal position. When the unit is opened, one panel acts as a table and the other panel acts as a backboard carrying the utensils.

U.S. Pat. No. 4,605,131 comprises a utility table for attachment to a vertical wall, particularly to a wall of a switch cabinet, with a tabletop platform and a support member joined to the wall such that it assumes an initial inoperative position folded parallel to the wall out of which the tabletop platform is moved into an inclined operative position. The support member moves into a supporting position due to its own weight whereby the tabletop platform is supported inclined to the wall so that it is prevented from returning to its initial inoperative position under load conditions.

U.S. Pat. No. 4,791,873 consists of a multi-purpose retractable desk or table top for use in conjunction with a shelving or wall system. The system includes vertical standards having channels which typically are receptive to shelf brackets. The retractable desk top is attached to the standards by a linkage and mechanism which enables the top to be infinitely oriented at any angle from horizontal to vertical. In its vertical, retracted configuration, the desk top lies substantially flat against the standards and the linkage is substantially concealed within the standards. The attachment linkage and mechanism is constructed to enable the height of the entire device to be adjusted.

U.S. Pat. No. 4,998,484 describes an improved and highly versatile wall mounted folding table with mounting brackets of various configurations, to allow the table to be mounted directly to planar wall surfaces and exposed wall support studs. By varying the vertical distance between the upper and lower mounting brackets, a forward sloping table surface is formed for use in drafting.

U.S. Pat. No. 5,460,101 depicts a wall-mounted foldable desk for providing an elevated working surface comprising two opposed and upwardly extended side plates, each side plate having top and bottom edges with front and rear edges extended therebetween; a bottom plate having front and rear edges with side edges extended therebetween with each side edge coupled to a bottom edge of a side plate; a back plate having top and bottom edges with side edges extended therebetween with the bottom edge coupled to the rear edge of the bottom plate, each side edge coupled to a rear edge of an adjacent side plate, and the top edge aligned with the top edges of each side plate; a first plate having a top surface and a bottom surface, front and rear edges, and opposed side edges extended between the front and rear edges; pivotal structure for pivotally coupling the side edges of the first plate between the side plates to define a pivotable desk top; extendable structure coupled between the desk top and sidewalls and having one position for allowing desk top to be extended upwards in an elevated orientation and another position for allowing the desk top to be extended downwards in a retracted orientation; and coupling structure adapted for coupling the back plate to a wall and thereby allowing the desk top to be placed in the elevated or retracted orientation.

U.S. Pat. No. 5,469,794 is directed to a table attached along the edge of one longitudinal side by hinges to a horizontally disposed rail which is intended for attachment to a substantially vertical structure possesses two legs each attached by a hinge to the table proximate either opposed corner of the table distal the edge attached to the rail. Both legs are mounted to: (a) support the table in a utility position with each leg being disposed perpendicular to the substantially planar bottom table surface and (b) to be disposed substantially flush to the bottom table surface in a closed position thereby allowing the table to be rotated about the horizontal, longitudinal hinges to a vertical position hanging from the rail by means of said hinges. The length of each leg is substantially equivalent to the distance between the floor and the hinged longitudinal and horizontal rail attachment. The hinges for holding the legs in both closed and open positions lock in either position. The longitudinal orientation of the table with respect to the rail optimizes the use of space in manner areas including a typical residential exterior deck and accommodates seating facing the rail which in the case of an exterior deck is outward over a railing. The vertical storage position enables the full use of the area in which the table is located, protects the upper table surface from precipitation in exterior applications and minimizes maintenance.

BRIEF SUMMARY OF THE INVENTION

The present invention is directed to a rotatable table which may be mounted on a support structure such as a wall. The table includes a shelf unit which is mounted to the support structure, and a rotatable unit which is rotatably connected to the shelf unit. The invention comprises a space-saving piece of furniture which is ideally suited for people in need of more living room while desiring to have a convenient, efficient, and attractive work area. The rotatable table is ideal for small rooms, dormitories, ships, mobile homes, RV's, and any other locations having a limited area. The table can be used as a work surface for studying, writing, sketching, computing, dining, ironing, baby changing, and similar purposes. The table has a rotatable work surface which can be place at various angles according to the needs of the user. In accordance with another feature of the invention, the shelf unit, and therefore the entire rotatable table, is vertically positionable on the support structure. This allows the rotatable table to be placed at a height which best serves the needs of the user.

In accordance with a preferred embodiment of the invention, a rotatable table which attaches to a support structure includes:

a shelf unit connectable to the support structure such that the shelf unit may be selectively vertically positioned with respect to the support structure, the shelf unit having at least one downwardly projecting positioning rod receiver;

a rotatable unit rotatably connected to the shelf unit, the rotatable unit having:

a work surface;

an underside having a truss assembly guide;

a truss assembly having (1) a truss anchor which is slidably positionably along the truss assembly guide, and (2) a positioning rod; and, wherein the rotatable unit may be rotated so that the positioning rod engages the positioning rod receiver of the shelf unit and retains the rotatable unit in a desired angular position In accordance with an aspect of the invention, a rotatable table which attaches to a support structure includes:

a shelf unit having:

a shelf;

two spaced apart downwardly projecting bearing channels connected to the shelf;

two spaced apart downwardly projecting positioning rod receivers connected to the shelf;

a bearing channel receiver connectable to the support structure, the bearing channel receiver having two spaced apart bearing channel sleeves wherein the bearing channel sleeves slidably receive the bearing channels of the shelf;

a rotatable unit rotatably connected to the shelf, the rotatable unit having:

a work surface;

an underside having a truss assembly guide;

a truss assembly having (1) a truss anchor which is slidably positionable along the truss assembly guide, and (2) a positioning rod; and, wherein the rotatable unit may be rotated so that the positioning rod engages the positioning rod receivers of the shelf unit thereby retaining the rotatable unit in a desired angular position.

In accordance with another aspect of the invention:

each positioning rod receiver has a positioning rod seat and at least one downwardly opening positioning rod receiving notch.

In accordance with another aspect of the invention:

each positioning rod receiver has a distal end having a roller which engages the support structure.

In accordance with another aspect of the invention:

each bearing channel has at least one roller which engages the support structure.

In accordance with another aspect of the invention:

a vertical positioning member is connected to the shelf unit, the vertical positioning member having:

the bearing channel sleeves each having at least one vertical indexing pin;

two spaced apart downwardly projecting vertical positioning channels connected to a release plate, the vertical positioning channels each having at least one row of vertically spaced teeth;

wherein the release plate may be moved toward the support structure so that a tooth of the row of teeth engages the vertical indexing pin thereby retaining the shelf unit in a fixed vertical position; and, wherein the release plate may be moved away from the support structure so that the tooth disengages from the vertical indexing pin thereby allowing the shelf unit to be vertically positioned with respect to the support structure.

In accordance with another aspect of the invention:

the release plate has at least one release plate handle for moving the release plate toward or away from the support structure.

In accordance with another aspect of the invention:

the truss assembly further includes:

two spaced apart truss arms connected to the positioning rod, the truss arms having a plurality of teeth;

two spaced apart truss sleeves rotatably connected to the truss anchor and which slidably receive the two truss arms;

the truss sleeves each having a spring loaded release pin which engages the teeth of the truss arms; and, wherein the truss arms may be slidably extended along the truss sleeves and locked in place by the spring loaded release pins.

In accordance with another aspect of the invention:

the underside of the rotatable unit has two spaced apart serrated strips;

the truss anchor has two serrated members; and, wherein the serrated members engage the serrated strips thereby holding the truss anchor in a fixed position along the truss assembly guide.

In accordance with another aspect of the invention:

the truss anchor includes two truss anchor release levers which may be pulled to disengage the serrated members from the serrated strips and thereby allow the truss anchor to slide along the truss assembly guide.

In accordance with another aspect of the invention:

a stop mechanism which is slidably positionable along truss assembly guide, wherein said stop mechanism may be selectively engaged to secure the truss anchor in a fixed position along the truss assembly guide.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 10 is a front elevation view of a vertical positioning member connected to the shelf unit;

FIG. 11 is a bottom plan view of the vertical positioning member and the shelf unit;

FIG. 12 is a side elevation view of the shelf unit with the vertical positioning member engaging vertical indexing pins in bearing channel sleeves;

FIG. 13 is a side elevation view of the shelf unit with the vertical positioning member disengaged from the vertical indexing pins in the bearing channel sleeves;

FIG. 14 is a side elevation view of the shelf unit moved downward to a new vertical position and the vertical positioning member again engaging the vertical indexing pins in the bearing channel sleeves;

FIG. 18 is a bottom plan view of the rotatable unit;

FIG. 19 is an enlarged view along the line 19-19 of FIG. 18;

FIG. 20 is an enlarged view along the line 20-20 of FIG. 18

FIG. 21 is a top plan view of a truss assembly;

FIG. 22 is a front elevation view of the truss assembly;

FIG. 23 is a side elevation view of the truss assembly;

FIG. 24 is a side elevation view of the truss assembly showing a rotated truss anchor;

FIG. 25 is a bottom plan view of the truss assembly;

DETAILED DESCRIPTION OF THE INVENTION

Figure 1:
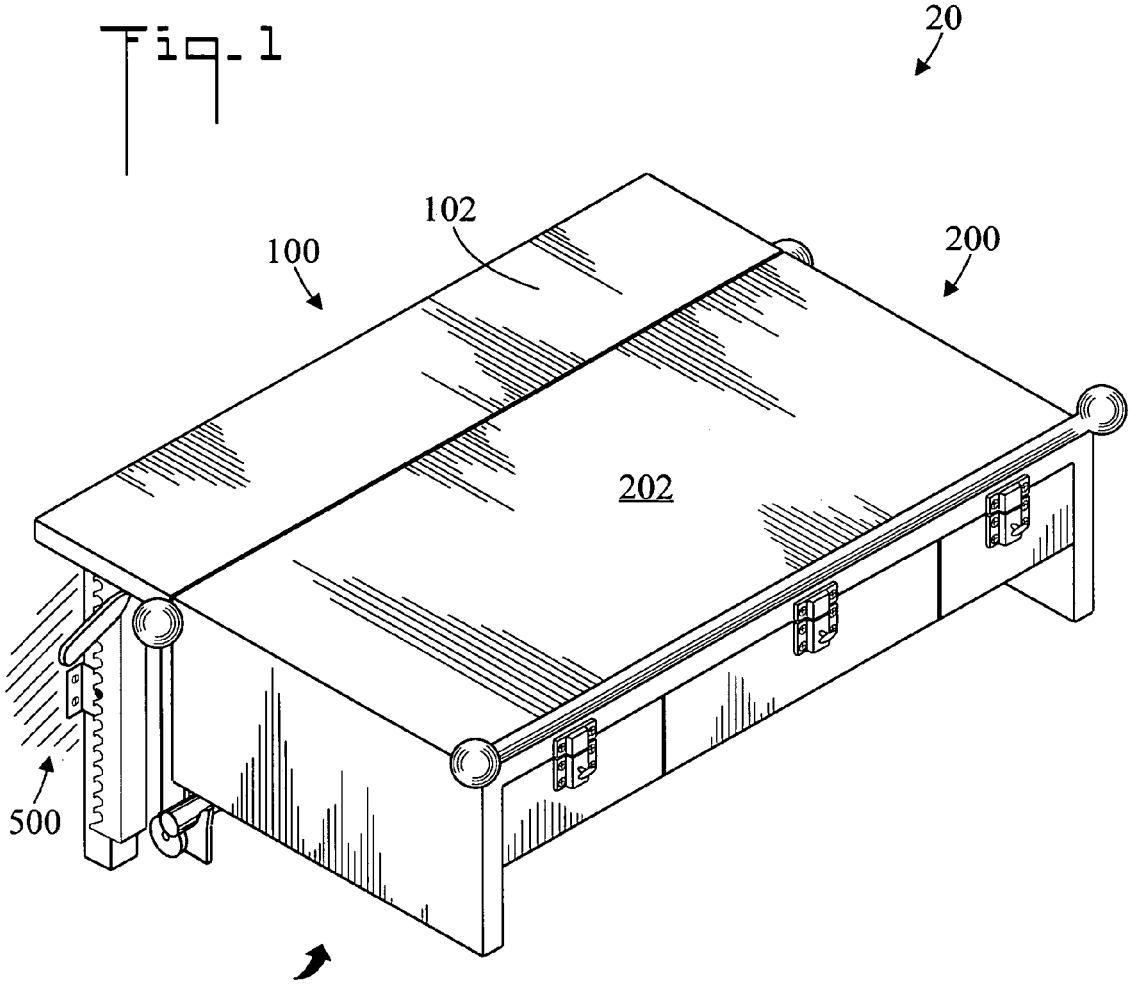
FIG. 1 is a perspective view of a rotatable table in accordance with the present shown in a horizontal position.
Figure 2:
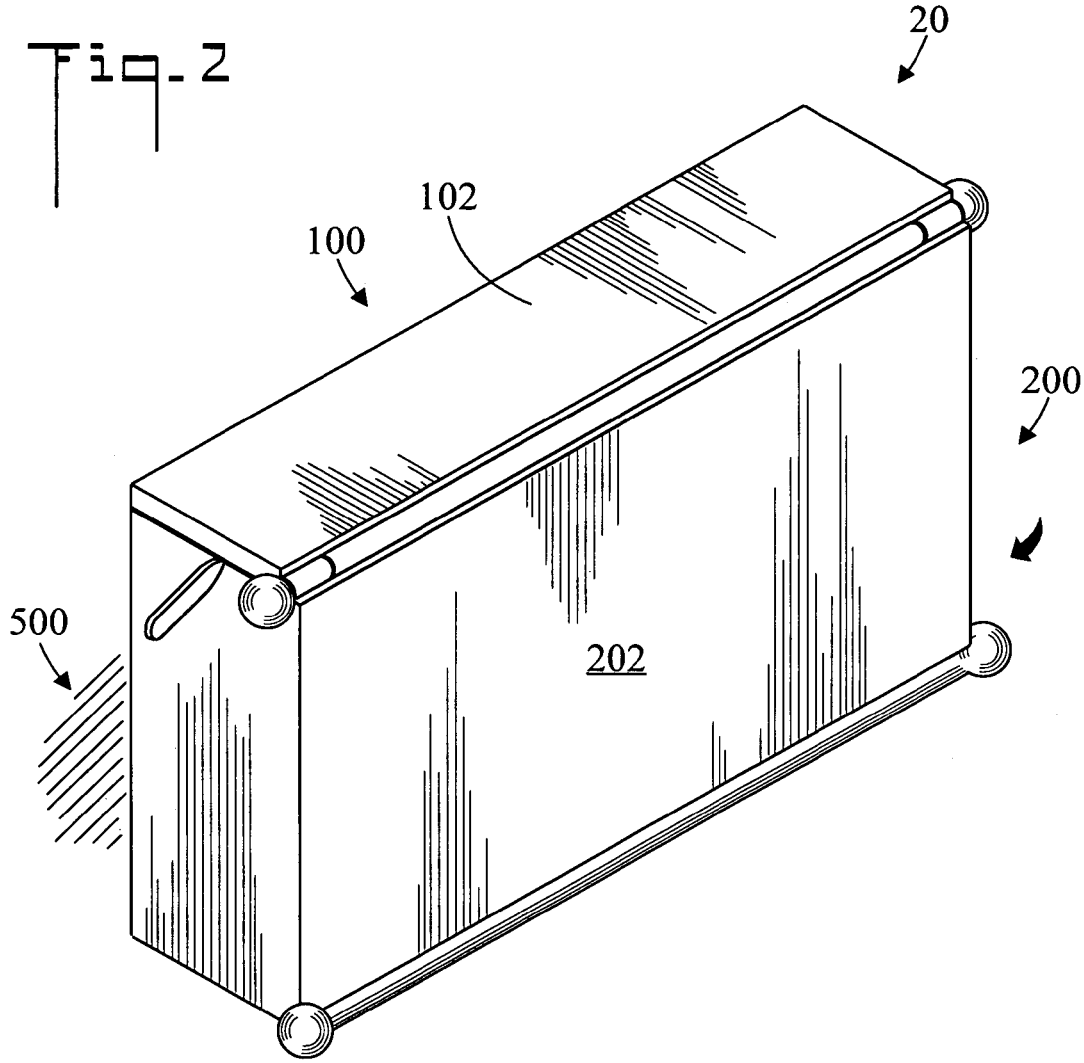
FIG. 2 is perspective view of the rotatable table in a vertical position.
Figure 3:
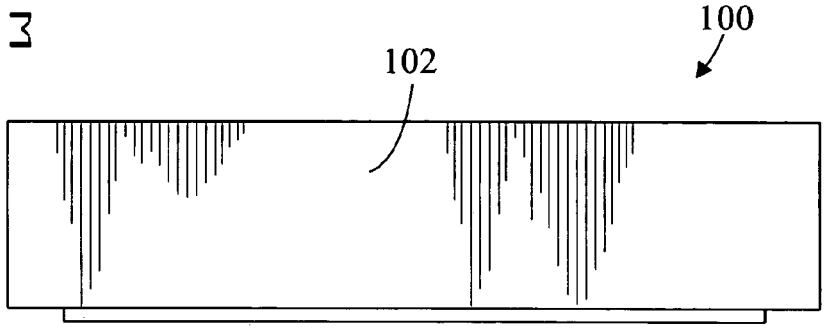
FIG. 3 is a top plan view of a shelf unit.
Figure 4:
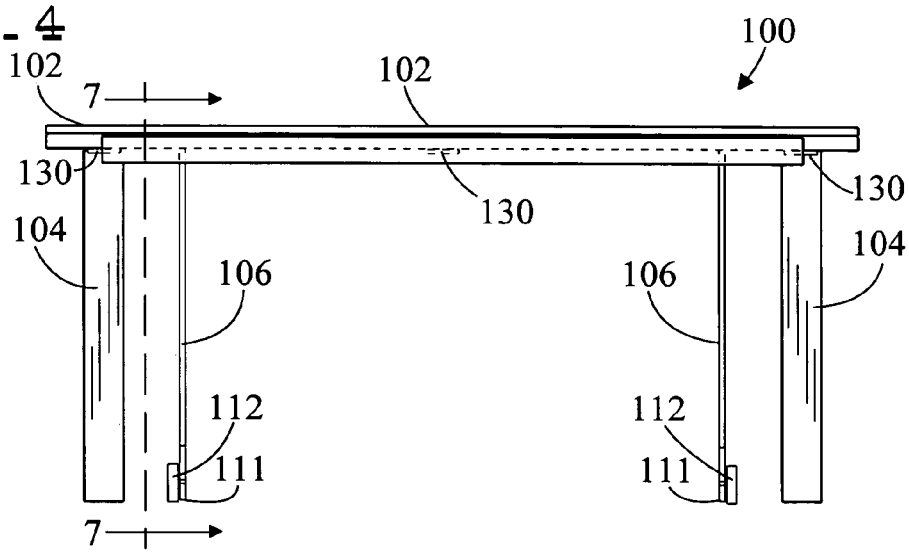
FIG. 4 is a front elevation view of the shelf unit.
Figure 5:
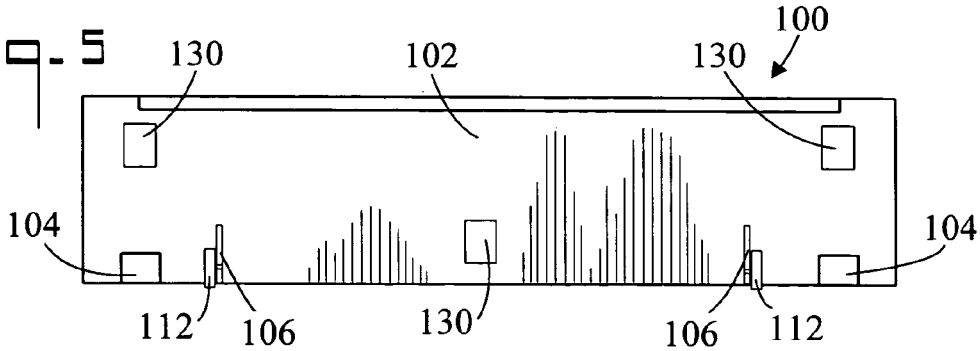
FIG. 5 is a bottom plan view of the shelf unit.
Figure 6:
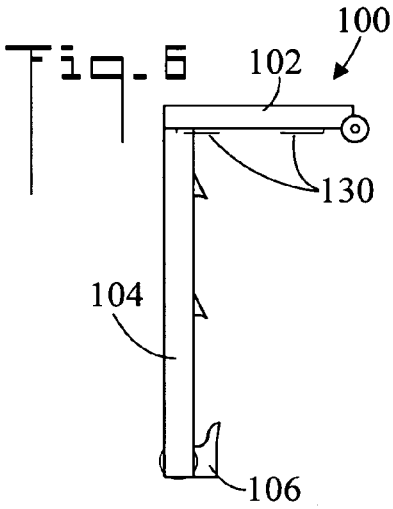
FIG. 6 is a side elevation view of the shelf unit.

Referring initially to FIGS. 1 and 2 there are illustrated perspective views of a rotatable table 20 in accordance with the present shown in the horizontal position and vertical positions respectively. Rotatable table 20 is attachable to a support structure 500 and includes a shelf unit 100 having a shelf 102, and a rotatable unit 200 having work surface 202 The rotatable unit 200 may be selectively positioned in the horizontal position of FIG. 1, the vertical position of FIG. 2, or at various angled positions therebetween. In the vertical or stowed position, rotatable table 20 assumes a position along support structure 500, thereby minimizing the space occupied by the rotatable table 20.

Now referring to FIGS. 3-7 there are illustrated top plan, front elevation, bottom plan, side elevation views respectively of shelf unit 100. Shelf unit 100 includes a shelf 102. Two spaced apart downwardly projecting bearing channels 104 are connected to shelf 102. In an embodiment of the invention, each bearing channel 104 has at least one roller 105 (two in the shown embodiment) which engages support structure 500 (refer to FIG. 9). Two spaced apart downwardly projecting positioning rod receivers 106 are also connected to shelf 102. In an embodiment of the invention, each positioning rod receiver 106 has a distal end 111 having a roller 112 which engages support structure 500. In another embodiment of the invention, each positioning rod receiver 106 has a positioning rod seat 108 and at least one downwardly opening positioning rod receiving notch 110 (two notches in the shown embodiment). Rollers 105 and 112 allow shelf unit 100 to roll along support structure 500 as rotatable table 20 is being vertically positioned.

Figure 7:
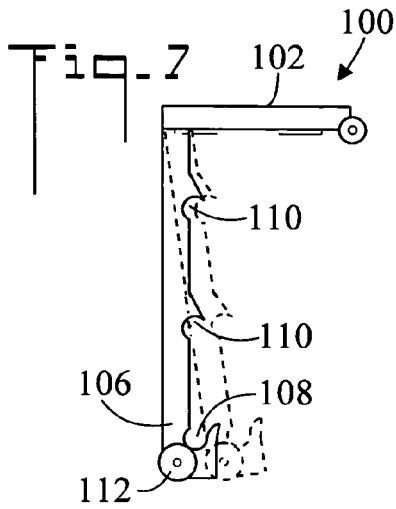
FIG. 7 is a side elevation view of the shelf unit showing a positioning rod receiver in a rotated position.

FIG. 7 is a side elevation view of shelf unit 100 showing positioning rod receiver 106 in a rotated position. The rotation accommodate irregularities in support structure 500 as shelf unit 100 is positioned vertically.

Figure 8:
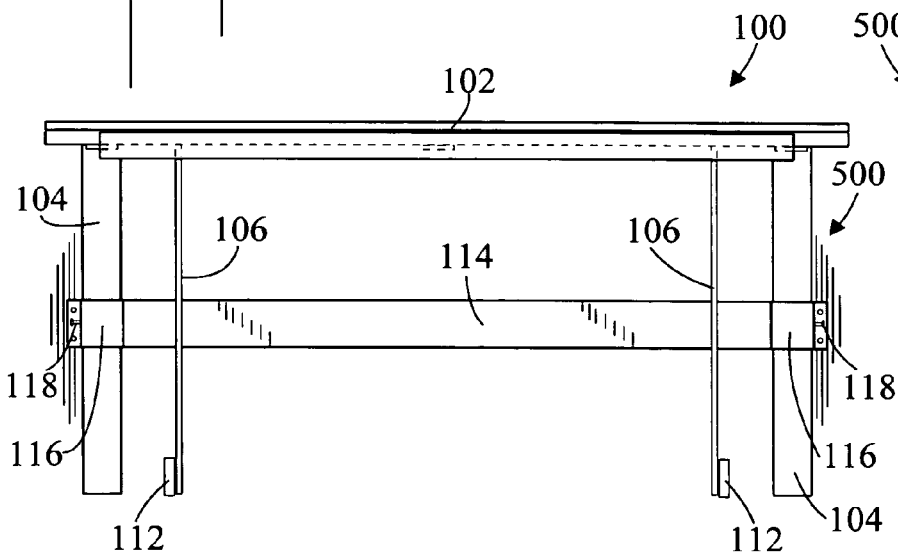
FIG. 8 is front elevation view of the shelf unit showing a bearing channel receiver which is used to connect the shelf unit to a support structure.
Figure 9:
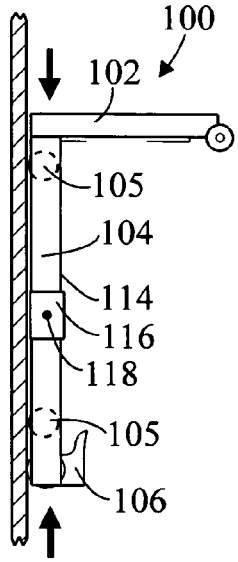
FIG. 9 is a side elevation view of the shelf unit connected to the support structure.

Now referring to FIGS. 8 and 9 there are illustrated front elevation and side elevation views respectively of shelf unit 100 attached (mounted) to support structure 500. Shelf unit 100 is attached to support structure 500 so that shelf 102 is disposed in a horizontal position with bearing channels 104 and positioning rod receivers 106 disposed in a vertical orientation below shelf 102. In a preferred embodiment of the invention, the attachment of shelf unit 100 to support structure 500 is effected by a bearing channel receiver 114 which is horizontally fixedly connectable to support structure 500 (also refer to FIG. 40). Bearing channel receiver 114 has two spaced apart bearing channel sleeves 116, wherein bearing channel sleeves 116 slidably receive bearing channels 104 of shelf 102. Bearing channel sleeves 116 each have at least one vertical indexing pin 118 (two pins each in the shown embodiment). A vertical positioning member (described below) connects shelf 102 to bearing channel receiver 114, and cooperates with vertical indexing pins 118 to facilitate vertical adjustment of shelf unit 100 with respect to support structure 500.

Figure 39:
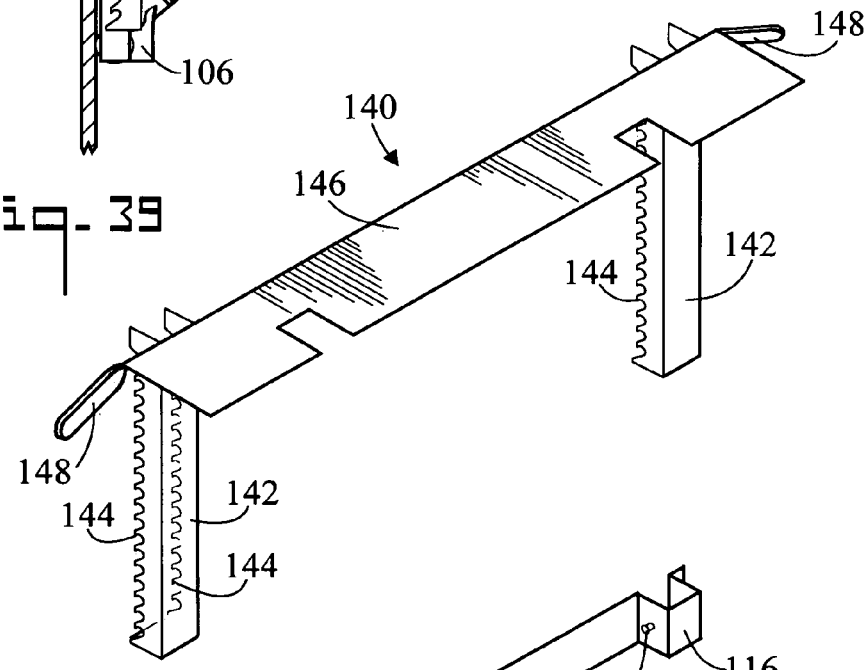
FIG. 39 is a perspective view of a vertical positioning member.

FIGS. 10 and 11 are front elevation and bottom plan views respectively of a vertical positioning member 140 connected to shelf unit 100. Refer also to FIG. 39 which shows a perspective view of vertical positioning member 140. Vertical positioning member 140 includes two spaced apart downwardly projecting vertical positioning channels 142 connected to a release plate 146. Vertical positioning channels 142 each have at least one row of vertically spaced teeth 144 (two rows each in the shown embodiment, refer also to FIGS. 12-14). Release plate 146 may be moved toward support structure 500 in direction 143 so that a tooth 144 engages vertical indexing pin 118 thereby retaining shelf unit 100 in a fixed vertical position. This is the position shown in FIG. 11. It may be appreciated that in the shown embodiment four teeth 144 engage four vertical indexing pins 118. Conversely, release plate 146 may be moved away from support structure 500 in direction 145 so that tooth 144 disengages from vertical indexing pin 118 thereby allowing shelf unit 100 to be vertically positioned with respect to support structure 500. Release plate 146 has at least one release plate handle 148 for moving release plate 148 toward or away from support structure 500. In an embodiment of the invention, springs 147 bias release plate 146 toward support surface 500 in direction 143 thereby locking shelf unit 100 in place. Spring 147 is mounted between a pin on release plate 146 and another pin on underside 103 of shelf 102. Release plate 146 is held in place on the underside of shelf 103 by retainers 130 mounted on underside 103 (also refer to FIGS. 4 and 9). One of the retainers 130 has a slot 131 which accepts a pin 132 connected to release plate 146. This slot 131 and pin 132 arrangement prevents release plate 146 from moving laterally with respect to shelf 102.

FIG. 12 is a side elevation view of shelf unit 100 with one tooth of row of teeth 144 of vertical positioning member 140 engaging vertical indexing pins 118 in bearing channel sleeves 116.

FIG. 13 is a side elevation view of shelf unit 100 with teeth 144 of vertical positioning member 140 disengaged (moved in direction 145) from the vertical indexing pins 118 in the bearing channel sleeves 116. In this position, shelf unit 100 may be vertically positioned on support structure 500.

FIG. 14 is a side elevation view of the shelf unit 100 moved downward in direction 149 to a new vertical position, and the teeth 144 of vertical positioning member 140 again engaging vertical indexing pins 118 in bearing channel sleeves 116.

Figure 15:
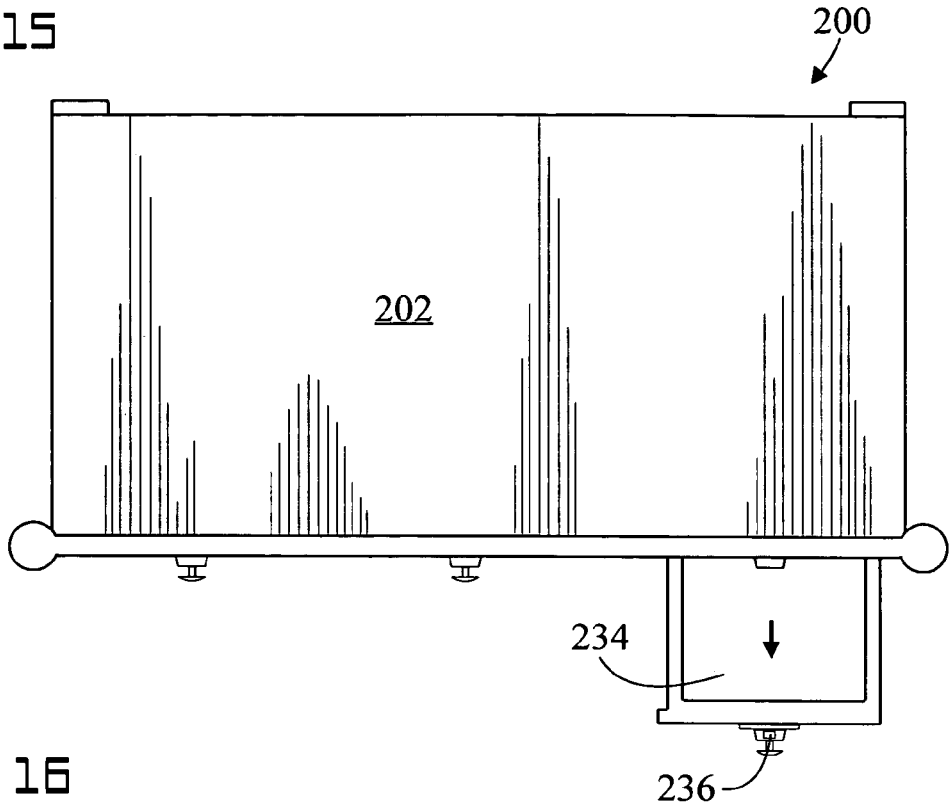
FIG. 15 is a top plan view of a rotatable unit of the rotatable table.
Figure 16:
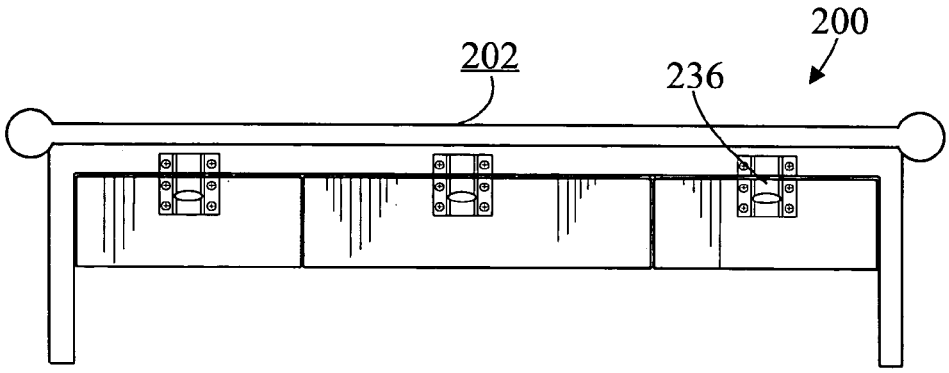
FIG. 16 is a front elevation view of the rotatable unit.
Figure 17:
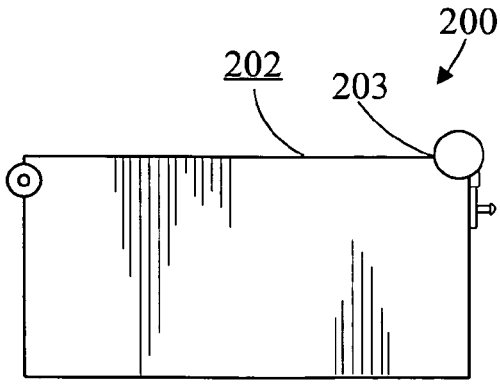
FIG. 17 is a side elevation view of the rotatable unit.

FIGS. 15-17 are top plan, front elevation, and side elevation views respectively of rotatable unit 200 of rotatable table 20 which is rotatably connected to shelf 102 of shelf unit 100. Rotatable unit 200 has a work surface 202 which may be selectively rotated from a horizontal position (shown) to a vertical position (refer to FIG. 2). Rotatable unit 200 further has a lip 203 for retaining items on work surface 202. Rotatable unit 200 has at least one drawer 234 (three in the shown embodiment). Drawer 234 has drawer latch 236 so that drawer 234 will not come open as rotatable unit 200 is rotated downward (refer to FIG. 2).

FIG. 18 is a bottom plan view of rotatable unit 200, FIG. 19 is an enlarged view along the line 19-19 of FIG. 18, and FIG. 20 is an enlarged view along the line 20-20 of FIG. 18. Rotatable unit 200 has an underside 203 which has an elongated truss assembly guide 204. Truss assembly guide 204 has two guide slots 201. A stop mechanism 205 is slidably positionable along truss assembly guide 204, and once positioned, may be locked in place by turning (clockwise to tighten and lock in place, or counterclockwise to loosen and slide). Underside 203 of rotatable unit 200 also has two spaced apart serrated (or corrugated) strips 216. Underside 203 of rotatable unit 200 also has a magnetic unit 207 which cooperates with a magnetic member 502 disposed on support structure 500 (also refer to FIG. 34). When rotatable unit 200 is placed in the vertical or stowed position, the mutual attraction of magnetic unit 207 and magnetic member 502 serve to hold rotatable unit 200 against support structure 500.

Now referring to FIGS. 21-25, there are illustrated top plan, front elevation, side elevation, side elevation, and bottom plan views respectively of a truss assembly 206. Truss assembly 206 has (1) a truss anchor 208 which is slidably positionable along truss assembly guide 204 (refer to FIGS. 18, 31, and 32), and (2) a positioning rod 210. Truss anchor 208 has two guide pins 211 which slidably engage guide slots 201 in truss assembly guide 204 (refer to FIGS. 19 and 32). Truss assembly 206 further includes two spaced apart truss arms 212 connected to positioning rod 210, truss arms 212 having a plurality of teeth 213 (also refer to FIG. 26). Two spaced apart truss sleeves 214 rotatably connect to truss anchor 208, and slidably receive two truss arms 212. Truss sleeves 214 each have a spring loaded release pin 215 which engages teeth 213 of truss arm 212, so that truss arms 212 may be slidably extended along truss sleeves 214 and locked in place by spring loaded release pin 215 (also refer to FIGS. 26 and 27). Truss anchor 208 has two serrated members 218 which cooperate with serrated strips 216, and two truss anchor release levers 220 (refer also to FIGS. 31 and 32 and the discussion pertaining thereto). Truss handle 224 is attached to truss arm 212 and moves along a slot 239 in truss sleeves 214. Truss anchor 208 also includes two leaf spring assemblies 222 which bias truss anchor 208 so that serrated members 218 engage serrated strips 216 (refer to FIGS. 31-33 and the discussions pertaining thereto). Truss assembly 206 further includes a truss handle 224 which may be used to manually control truss assembly 206 to achieve various angular positions of rotatable unit 200. Truss anchor 208 includes two truss anchor release levers 220 which may be pulled to disengage serrated members 218 from serrated strips 216 and thereby allow truss anchor 208 to slide to a different position along truss assembly guide 204 (refer also to FIGS. 32 and 33).

Figure 26:
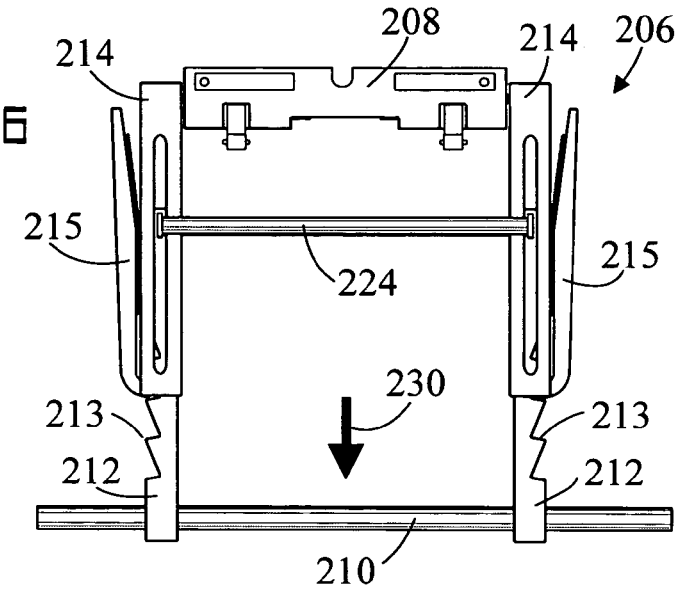
FIG. 26 is a rear elevation view of the truss assembly showing the assembly in an extended position.

FIG. 26 is a rear elevation view of truss assembly 206 showing the assembly in an extended position. Positioning rod 210 has moved in direction 230 which causes truss arm 212 to extend from truss sleeve 214 and teeth 213 to ratchet along spring loaded release pin 215.

Figure 27:
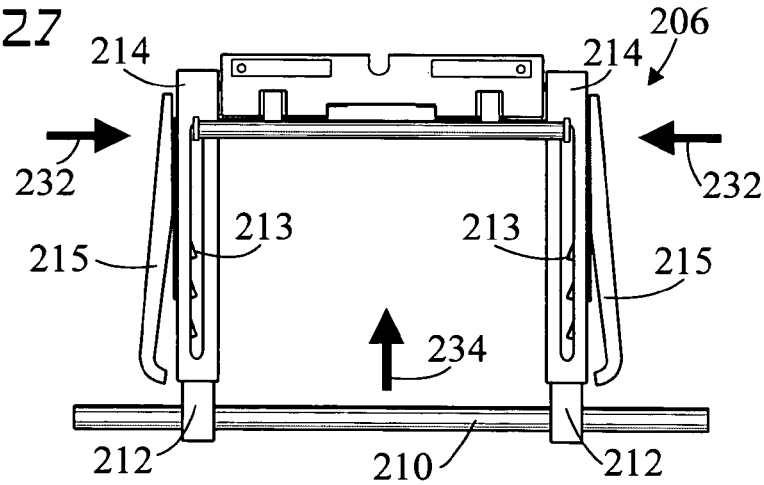
FIG. 27 is a rear elevation view of the truss assembly showing the assembly in a compressed position.

FIG. 27 is a rear elevation view of truss assembly 206 showing the assembly in a compressed position. Spring loaded release pins 215 have been pressed in direction 232 causing spring loaded release pins 215 to become disengaged from teeth 213. Positioning rod 210 has then moved in direction 234 which causes truss arms 212 to enter truss sleeve 214. FIGS. 26 and 27 demonstrate how truss assembly 206 may be extended and compressed. The extension operation generally takes place when rotatable unit 200 is moved from the stowed vertical position (refer to FIG. 2) to the horizontal position (refer to FIG. 1). Conversely, the compression operation generally take place when rotatable unit 200 is moved the horizontal position back to the stowed position.

Figure 28:
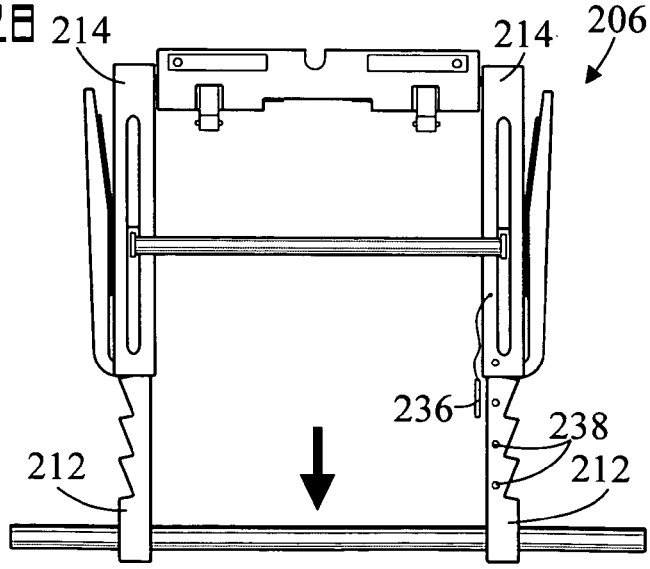
FIG. 28 is a rear elevation view of the truss assembly in a fully extended position.

FIG. 28 is a rear elevation view of truss assembly 206 in a fully extended position. As a safety precaution a pin 236 may be inserted in a holes 238 in truss arm 212 and truss sleeve 214. Pin 236 ensures that truss assembly 206 is locked at the desired degree of extension and cannot collapse. This feature is particularly use if rotating table 20 is being used as a platform to change a babies diapers and collapse could cause an injury. Stop mechanism 205 can also be utilized as a safety device (refer to FIG. 31 and the discussion pertaining thereto).

Figure 29:
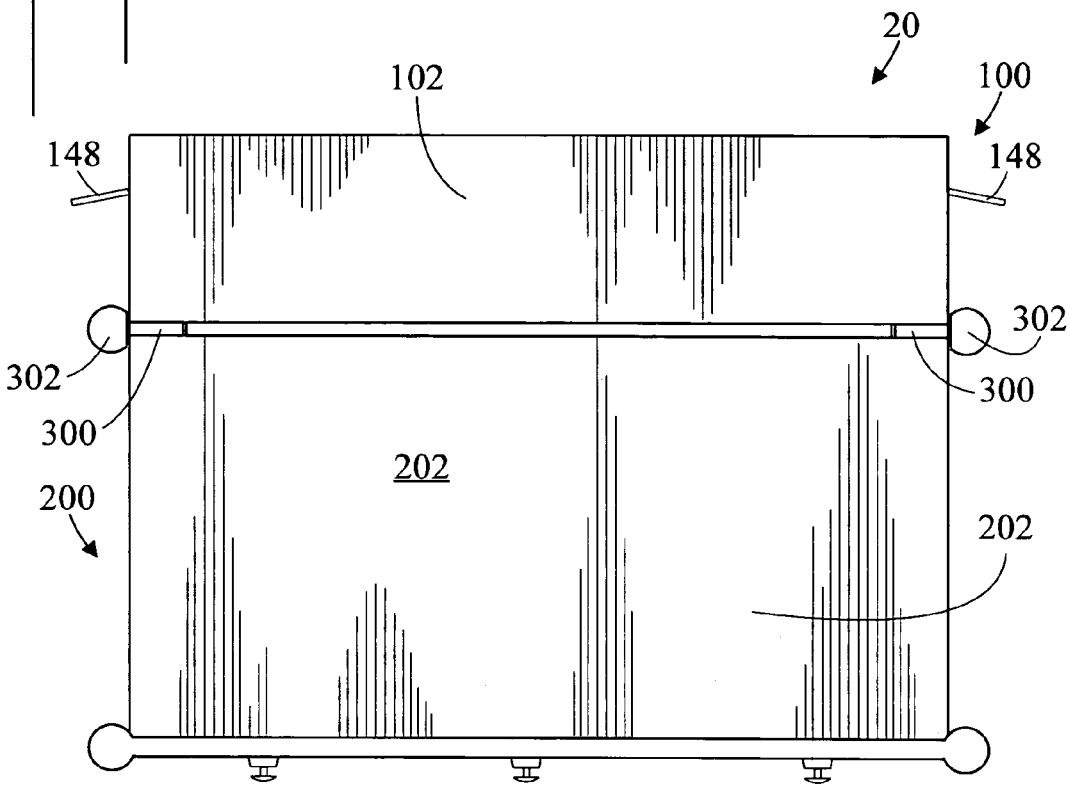
FIG. 29 is a top plan view of rotatable table with the work surface in a horizontal position.

FIG. 29 is a top plan view of rotatable table 20 with work surface 202 in a horizontal position. Rotatable unit 200 is rotatably connected to shelf unit 100. It is noted that rotatable unit 200 is removably connected to shelf unit 100. The removable connection is effected by hinges 300 which are located on shelf unit 100 and rotatable unit 200, and into which a hinge pin 302 may be selectively inserted (also refer to FIG. 30).

Figure 30:
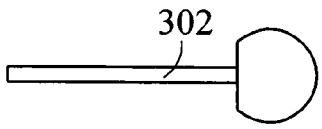
FIG. 30 is an enlarged side elevation view of a hinge pin.

FIG. 30 is an enlarged side elevation view of hinge pin 302.

Figure 31:
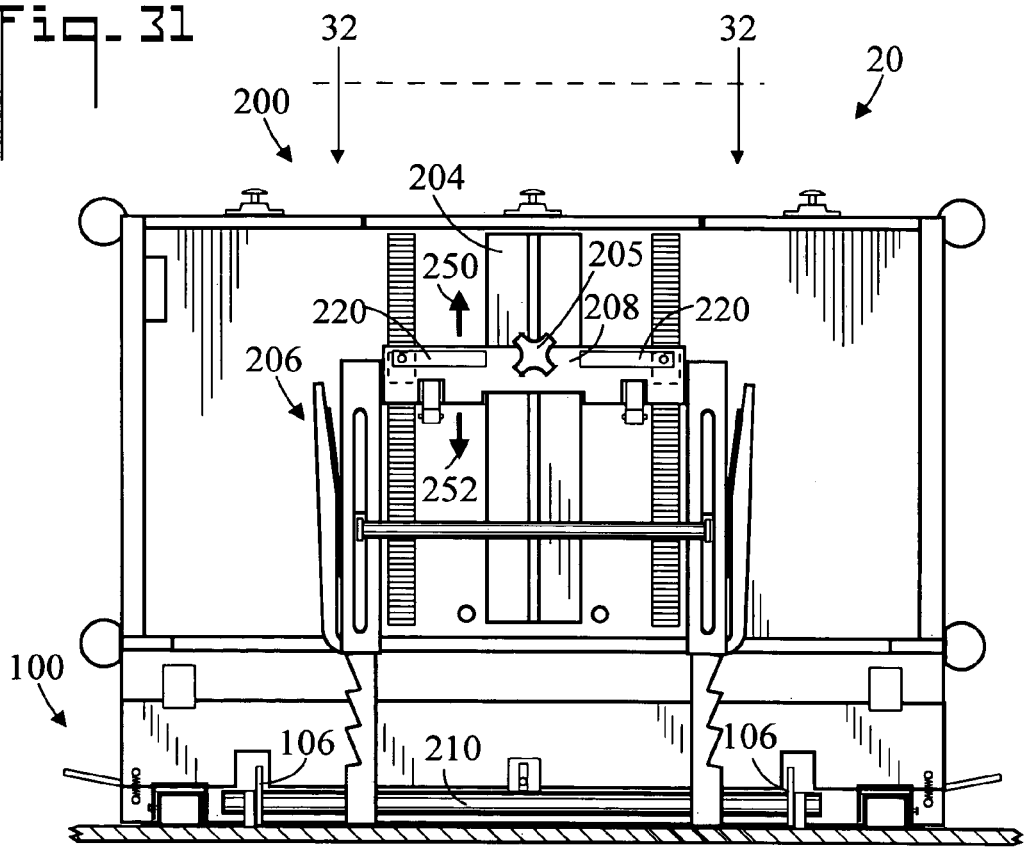
FIG. 31 is a bottom plan view of the rotating table.
Figure 32:
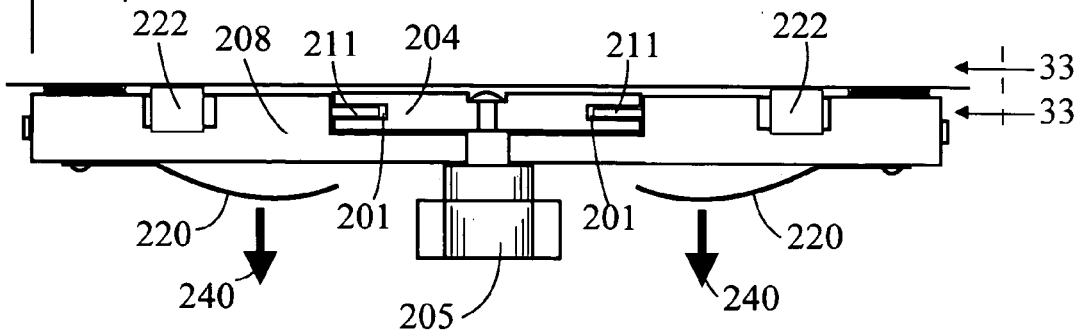
FIG. 32 is an enlarged view along the line 32-32 of FIG. 31.
Figure 33:
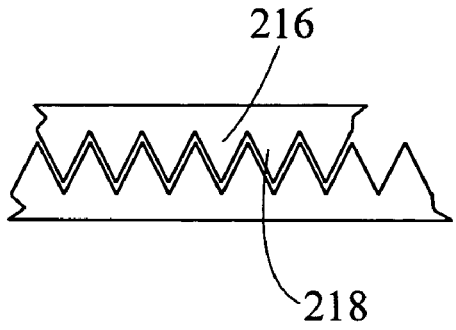
FIG. 33 is an enlarged view along the line 33-33 of FIG. 32.

FIG. 31 is a bottom plan view of rotating table 20, and FIG. 32 is an enlarged view along the line 32-32 of FIG. 31, and FIG. 33 is an enlarged view along the line 33-33 of FIG. 32. Truss anchor 208 of truss assembly 206 slidably engages truss assembly guide 204, and position rod 210 of truss assembly engages positioning rod receiver 106. Truss anchor 208 moves can move in directions 250 and 252 along truss assembly guide 204 and thereby change the orientation of rotatable unit 200 (refer also to FIGS. 35-38). Referring specifically to FIG. 32, guide slots 201 (also refer to FIG. 19) in truss assembly guide 204 slidably receive guide pins 211 of truss anchor 208 of truss assembly 206 thereby permitting truss anchor 208 to captively slide along truss assembly guide 204. Once truss anchor 208 is in a desired position along truss assembly guide 204, serrated members 218 of truss anchor 208 engage serrated strips 216 on the underside 203 of rotatable table 200 thereby holding truss anchor 208 in a fixed position along truss assembly guide 204. Truss anchor 208 includes two truss anchor release levers 220 which may be pulled in direction 240 to disengage serrated members 218 from serrated strips 216 and thereby allow truss anchor 208 to slide to a different position along truss assembly guide 204. Stop mechanism 205 may be tightened to secure truss anchor 208 in a fixed position along truss assembly guide 204. In other words stop mechanism 205 can serve as a safety device which prevents truss anchor 208 from moving and perhaps collapsing rotatable unit 200. Stop mechanism 205 can also be utilized to hold rotatable unit 200 in a desired angular position between vertical and horizontal. Leaf spring members 222 rotationally bias truss anchor 208 so that serrated strips 216 engage serrated members 218.

FIGS. 34-38 are side elevation views of rotatable table 20 showing rotatable unit 200 in various angular positions. Rotatable unit 200 may be rotated so that positioning rod 210 engages positioning rod receivers 106 of shelf unit 100, and retains said rotatable unit 200 in a desired angular position.

Figure 34:
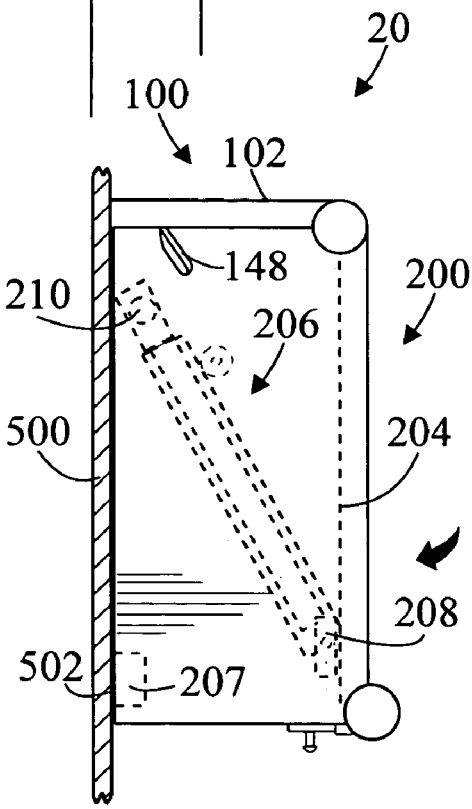
FIG. 34 is a side elevation view of the rotatable table the vertical or stowed position.

FIG. 34 is a side elevation view of rotatable table 20 in the vertical or stowed position wherein rotatable unit 200 has been rotated downward to a vertical orientation. In this position truss assembly 206 resides in an angled upward orientation, and positioning rod 210 is disengaged from positioning rod receiver 106 (refer also to FIG. 35). Truss anchor 208 resides near the distal end of truss assembly guide 204. In the vertical position, magnetic unit 207 or rotatable unit 200 cooperates with a magnetic member 502 disposed on support structure 500. When rotatable unit 200 is placed in the vertical or stowed position, the mutual attraction of magnetic unit 207 and magnetic member 502 serve to hold rotatable unit 200 against support structure 500.

Figure 35:
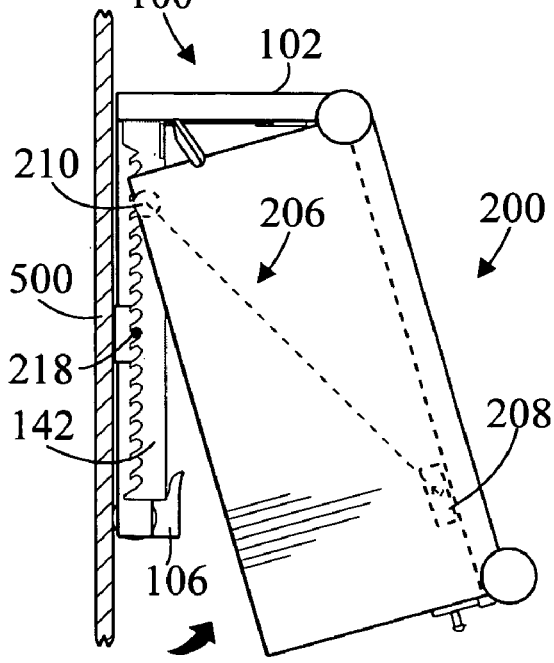
FIG. 35 is a side elevation view of rotatable table in an easel position.

FIG. 35 is a side elevation view of rotatable table 20 in a detent easel position. Rotatable unit 200 has been rotated upward wherein positioning rod 210 engages one of the positioning rod receiving notches 110 of shelf unit 100 and then released (refer also to FIG. 7). This slightly angled position of rotatable unit 200 is ideal for use as an easel. It is noted that for simplicity in FIGS. 35-37 truss assembly 206 has been depicted as a dashed line.

Figure 36:
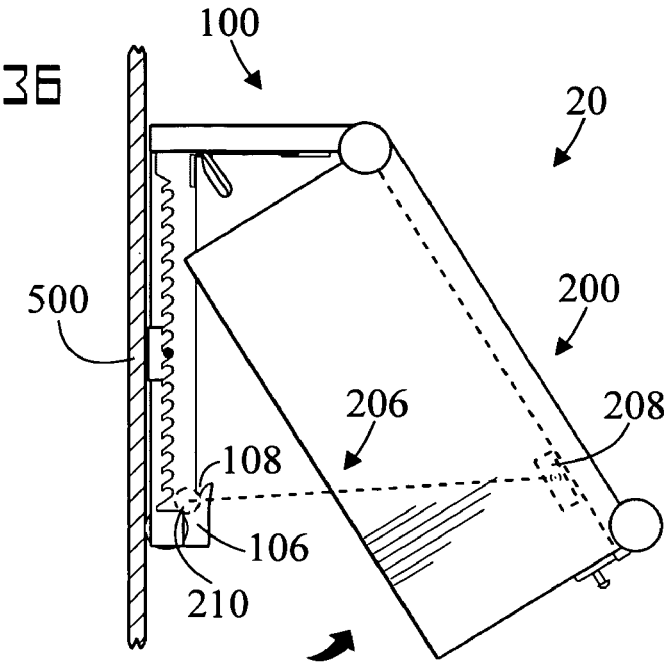
FIG. 36 is a side elevation view of rotatable table rotated upward to another angled position.

FIG. 36 is a side elevation view of rotatable table 20 rotated upward to another angled position. In this position positioning rod 210 drops and engages positioning rod seat 108 of position rod receiver 106 (refer also to FIG. 7). Rotatable unit 200 may be left in this position or rotated further upward as is shown in FIGS. 37 and 38.

Figure 37:
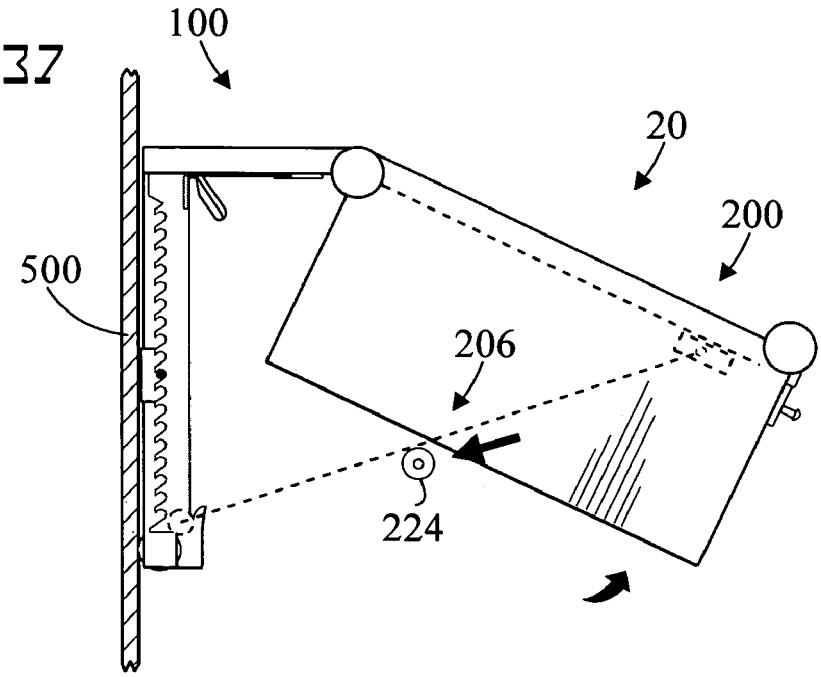
FIG. 37 is a side elevation view of rotatable table rotated further upward toward a horizontal position.

FIG. 37 is a side elevation view of rotatable table 20 rotated further upward toward a horizontal position. Truss handle 224 is used to manually hold truss arms 212 in place thereby allowing truss sleeve 214 to extend from truss arms 212 so that rotatable unit 200 may rotate upward (also refer to FIG. 26).

Figure 38:
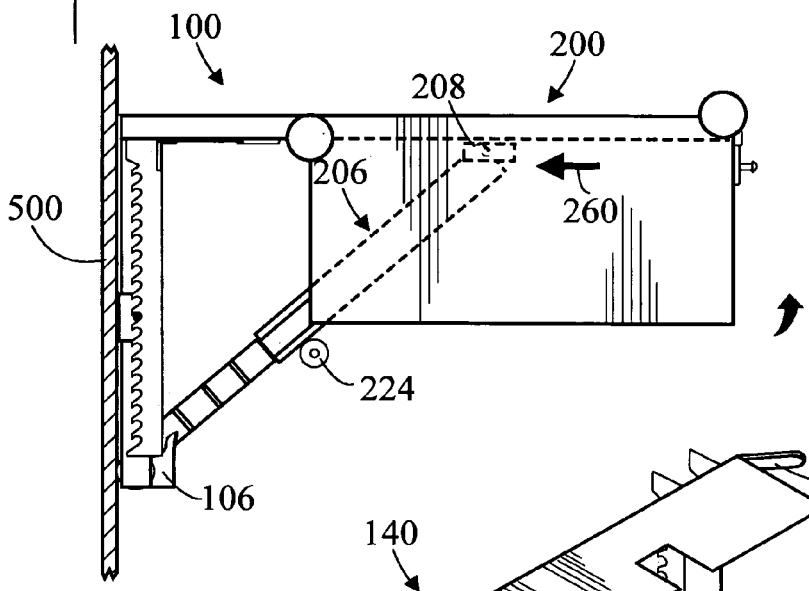
FIG. 38 is a side elevation view of rotatable table in the horizontal position.

FIG. 38 is a side elevation view of rotatable table 20 in the horizontal position. Rotatable unit 200 is rotated to the horizontal position, and truss anchor 208 is then moved toward support structure 500 in direction 260. To effect the move of truss anchor 208, truss anchor release levers 220 are pulled so that serrated members 218 disengage from serrated strips 216 thereby allowing truss anchor 208 to slidably move along truss assembly guide 204 (refer also to FIGS. 31-33). Once truss anchor 208 is in place, truss anchor release levers 220 are released so that serrated members 218 again engage serrated strips 216.

FIG. 39 is a perspective view of vertical positioning member 140. Vertical positioning member 140 includes two spaced apart downwardly projecting vertical positioning channels 142 connected to a release plate 146. Vertical positioning channels 142 each have at least one row of vertically spaced teeth 144 (two rows each in the shown embodiment. Release plate 146 has at least one release plate handle 148 for effecting the movement toward or away from support structure 500.

Figure 40:
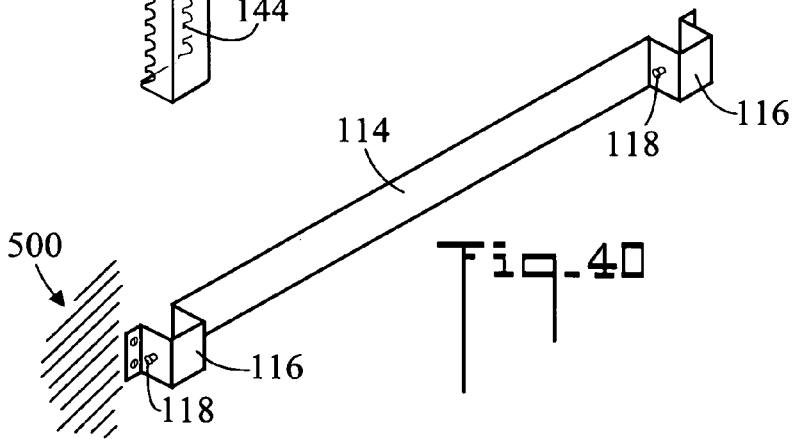
FIG. 40 is a perspective view of a bearing channel receiver.

FIG. 40 is a perspective view of a bearing channel receiver 114. Bearing channel receiver 114 has two spaced apart bearing channel sleeves 116, wherein bearing channel sleeves 116 slidably receive bearing channels 104 of shelf 102 (refer to FIG. 8). Bearing channel sleeves 116 each have at least one vertical indexing pin 118 (two pins each in the shown embodiment).

Figure 41:
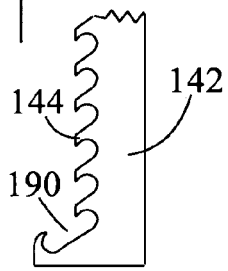
FIG. 41 is an enlarged fragmented side elevation view of a vertical positioning channel; and, FIG. 42 is an enlarged top plan view of a leaf spring assembly.

FIG. 41 is an enlarged fragmented side elevation view of a second embodiment of vertical positioning channel 142 (refer also to FIGS. 12-14, 39, and 40). In this embodiment an extended notch 190 is disposed at the lower portion of vertical positioning channel 142. Notch 190 prevents inadvertent extraction of bearing channel 104 from bearing channel sleeve 116.

Figure 42:
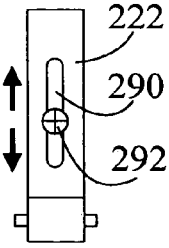

FIG. 42 is an enlarged top plan view of a second embodiment of leaf spring assembly 222 (refer also to FIG. 21). In this embodiment leaf spring assembly 222 has an adjustment slot 290 which cooperates with an adjustment screw 292 connected to truss anchor 208 to allow leaf spring assembly 222 to be moved lengthwise with respect to truss anchor 208.

In terms of use, a method for using a rotatable table 20 includes:

(a) providing a support structure 500;

(b) providing a rotatable table 20 including:

a shelf unit 100 having a shelf 102, at least one downwardly projecting positioning rod receiver 106 connected to shelf 102, positioning rod receiver 106 having a positioning rod seat 108 and at least one positioning rod receiving notch 110;

a rotatable unit 200 rotatably connected to shelf 102, rotatable unit 200 having a work surface 202, and an underside 203 having a truss assembly guide 204;

a truss assembly 206 having (1) a truss anchor 208 which is slidably positionable along truss assembly guide 204, and (2) a positioning rod 210;

(c) connecting shelf unit 100 to support structure 500 so that shelf 102 is disposed in a horizontal position and positioning rod receiver 106 is disposed below shelf 102;

(d) placing rotatable unit 200 in a vertical or stowed position (refer to FIG. 2);

(e) rotating rotatable unit 200 up and away from support structure 500 until positioning rod 210 engages positioning rod receiving notch 110 of shelf unit 100 and retains rotatable unit 200 in an angled position. In an embodiment of the invention, the rotation is effected so that the positioning rod 210 engages an uppermost positioning rod receiving notch 110 on the positioning rod receiver 106. This places the rotatable table in a slightly angled "easel" position; (refer to FIG. 35).

(f) continuing to rotate rotatable unit 200 up and away from support structure 500 until positioning rod 210 engages positioning rod seat 108; (refer to FIG. 36)

(g) while holding truss assembly 206, rotating rotatable unit 200 to a horizontal position thereby causing positioning arm 210 to extend away from truss anchor 208; In an embodiment of the invention, during this step truss handle 224 is used to manually hold truss arms 212 in place thereby allowing truss sleeves 214 to extend from truss arms 212 so that rotatable unit 200 may rotate upward (also refer to FIGS. 26, 37, and 38). As truss arms 212 are extend spring loaded release pin 215 will ratchet along teeth 213 in truss arms 212 thereby making a clicking noise. The user can gauge the rotation of rotatable unit 200 by counting the number of clicks. In an embodiment of the invention three clicks are required to extend positioning rod 210 the desired distance, however the number of clicks can vary as a function of teeth dimensions and the width of shelf 102; and, (h) moving truss anchor 208 toward support structure 500 thereby locking rotatable unit 200 in the horizontal position. (refer to FIG. 38) In an embodiment of the invention, the movement of truss anchor 208 is effected by using truss anchor release levers 220 to disengage serrated members 218 from serrated strips 216 and thereby allow truss anchor 208 to slide along truss assembly guide 204. The truss anchor release levers 222 are rotated from the stowed position to the in use position (refer also to FIG. 25). Once truss anchor 208 is in proper position, truss anchor release levers 220 are released thereby allowing serrated members 218 and serrated strips 216 to engage and hold truss anchor 208 in place along truss assembly guide 204. (refer to FIGS. 32 and 38). Truss anchor release levers 220 may then be returned to the stowed position (refer to FIG. 25).

The method further including:

in step (b), providing a stop mechanism 205 which is slidably positionable along truss assembly guide 204; and, engaging stop mechanism 205 to prevent truss anchor 208 from moving along truss assembly guide 204. In an embodiment of the invention, stop mechanism 205 is moved into abutting relationship with truss anchor 208 and turned clockwise to lock it in fixed relationship with truss assembly guide 204 (refer to FIG. 31). It is also noted that stop member 205 may be utilized to place rotatable unit 200 in various angular positions between horizontal and vertical.

The method further including returning rotatable unit 200 to a vertical position as follows:

in (b), truss assembly 206 having a truss anchor release lever 220, a truss arm 212 which is slidably received by a truss sleeve 214, a spring loaded release pin 215, and a truss handle 224;

disengaging stop mechanism 205;

pressing down on truss anchor release lever 220 and pulling truss anchor 208 away from support surface 500, thereby causing rotatable unit 200 to rotate downward;

pressing inward on spring loaded release pin 215 which allows truss arm 212 to enter truss sleeve 214;

using truss handle 224 to rotate truss assembly 206 upward so that rotatable unit 200 may assume a vertical position (refer to FIG. 34).

The method further including:

in step (b), providing a vertical positioning member 140; and, after step (e) and before step (f), using said vertical positioning member 140 to adjust shelf unit 100 to a desired vertical position (refer to FIGS. 11-14).

The preferred embodiments of the invention described herein are exemplary and numerous modifications, variations, and rearrangements can be readily envisioned to achieve an equivalent result, all of which are intended to be embraced within the scope of the appended claims.

I claim:

1. A rotatable table which attaches to a support structure, said rotatable table comprising:

a shelf unit having a shelf;

a rotatable unit rotatably connected to said shelf unit, said rotatable unit having:

a work surface;

an underside having a truss assembly guide;

a truss assembly having (1) a truss anchor which is slidably positionable along said truss assembly guide, and (2) a positioning rod;

wherein said rotatable unit may be selectively placed in a horizontal position, a vertical position, and at angled positions therebetween;

said shelf unit further including:

two spaced apart downwardly projecting bearing channels connected to said shelf;

two spaced apart downwardly projecting positioning rod receivers connected to said shelf;

a bearing channel receiver connectable to the support structure, said bearing channel receiver having two spaced apart bearing channel sleeves which slidably receive said bearing channels of said shelf unit; and, wherein said rotatable unit may be rotated so that said positioning rod engages said positioning rod receivers of said shelf unit thereby retaining said rotatable unit in a desired angular position.

2. The rotatable table according to claim 1, further including:

each said positioning rod receiver having a positioning rod seat and at least one downwardly opening positioning rod receiving notch.

3. The rotatable table according to claim 1, further including:

each said positioning rod receiver having a distal end having a roller engageable with the support structure.

4. The rotatable table according to claim 1, further including:

a vertical positioning member connected to said shelf unit said vertical positioning member having:

said bearing channel sleeves each having at least one vertical indexing pin;

two spaced apart downwardly projecting vertical positioning channels connected to a release plate, said vertical positioning channels each having at least one row of spaced teeth;

wherein said release plate may be moved toward said support structure so that a tooth of said row of teeth engages said vertical indexing pin thereby retaining said shelf unit in a fixed vertical position; and, wherein said release plate may be moved away from the support structure so that said tooth disengages from said vertical indexing pin thereby allowing said shelf unit to be vertically positioned with respect to the support structure.

5. The rotatable table according to claim 4, further including:

said release plate having at least one release plate handle for moving said release plate toward or away from the support structure.

6. A rotatable table which attaches to a support structure said rotatable table comprising:

a shelf unit having a shelf;

a rotatable unit rotatably connected to said shelf unit, said rotatable unit having:

a work surface;

an underside having a truss assembly guide;

a truss assembly having (1) a truss anchor which is slidably positionable along said truss assembly guide, and (2) a positioning rod;

wherein said rotatable unit may be selectively placed in a horizontal position, a vertical position, and at angled positions therebetween;

said truss assembly further including:

two spaced apart truss arms connected to said positioning rod, said truss arms having a plurality of teeth;

two spaced apart truss sleeves rotatably connected to said truss anchor and which slidably receive said two truss arms;

said truss sleeves each having a spring loaded release pin which engages said teeth of said truss arms; and, wherein said truss arms may be slidably extended along said truss sleeves and locked in place by said spring loaded release pins.

7. A rotatable table which attaches to a support structure, said rotatable table comprising:

a shelf unit having a shelf;

a rotatable unit rotatable connected to said shelf unit, said rotatable unit having:

a work surface;

an underside having a truss assembly guide;

a truss assembly having (1) a truss anchor which is slidably positionable along said truss assembly guide, and (2) a positioning rod;

wherein said rotatable unit may be selectively placed in a horizontal position, a vertical position, and at angled positions therebetween;

said underside of said rotatable unit having two spaced apart serrated strips;

said truss anchor having two serrated members; and, wherein said serrated members engage said serrated strips thereby holding said truss anchor in a fixed position along said truss assembly guide.

8. The rotatable table according to claim 7, further including:

said truss anchor including two truss anchor release levers which may be pulled to disengage said serrated members from said serrated strips and thereby allow said truss anchor to slide along said truss assembly guide.

9. A rotatable table which attaches to a support structure, said rotatable table comprising:

a shelf unit having a shelf;

a rotatable unit rotatably connected to said shelf unit, said rotatable unit having:

a work surface;

an underside having a truss assembly guide;

a truss assembly having (1) a truss anchor which is slidably positionable along said truss assembly guide, and (2) a positioning rod;

wherein said rotatable unit may be selectively placed in a horizontal position, a vertical position, and at angled positions therebetween; and, a stop mechanism slidably positionable along said truss assembly guide, wherein said stop mechanism may be selectively engaged to secure said truss anchor in a fixed position along said truss assembly guide.

* * * * *